United States Patent [19]

Sato et al.

[11] 4,115,982

[45] Sep. 26, 1978

[54] TUBE CASER

[75] Inventors: Atsushi Sato, Chiba; Hikotarou Kawaguchi, Sakura, both of Japan

[73] Assignee: Kao Soap Co., Ltd., Tokyo, Japan

[21] Appl. No.: 826,401

[22] Filed: Aug. 22, 1977

[30] Foreign Application Priority Data

Sep. 27, 1976 [JP] Japan ..... 51-129536[U]

[51] Int. Cl.[2] ..... B65B 5/08; B65B 5/10

[52] U.S. Cl. ..... 53/534; 53/247

[58] Field of Search ..... 53/160, 166, 246, 247, 53/248

[56] References Cited

U.S. PATENT DOCUMENTS

| | | | |
|---|---|---|---|
| 3,546,837 | 12/1970 | Shuttleworth | 53/247 X |
| 3,869,843 | 3/1975 | Darrah et al. | 53/247 X |
| 3,926,336 | 12/1975 | Graham et al. | 53/248 X |
| 3,991,539 | 11/1976 | Luca | 53/248 X |

*Primary Examiner*—Robert Louis Spruill

*Attorney, Agent, or Firm*—Blanchard, Flynn, Thiel, Boutell & Tanis

[57] ABSTRACT

An apparatus for feeding tubes into receptacles comprising conveyor means for intermittently shifting a receptacle, a chute for feeding rows of tubes, a frame for moving rows of the tubes onto the upper side of the receptacle and a stuffing plate for stuffing the tubes into the receptacle.

1 Claim, 13 Drawing Figures

TUBE CASER

BACKGROUND OF THE INVENTION

FIELD OF THE INVENTION

This invention relates to an apparatus for arranging tubes in rows. More particularly, the present invention relates to a tube caser in which a continuous operation of arranging tubes in rows on a tray and fitting the tubes in the tray is carried out at a high efficiency by intermittently shifting the tray and setting the tubes row by row onto the tray.

It is known to package tubes by fitting the mouth portions of the tubes into concave portions of a tray. In this known method, the operation of fitting the tubes into the tray is done manually. The tube caser of the present invention makes it possible to carry out this operation mechanically and automatically.

In conventional extruded tubes, such as toothpaste tubes, the seal portion on the end opposite to the mouth portion of the tube is press-bonded in a more or less linear or plate-like form, and therefore, the width of the plate-like seal portion is larger than the diameter of a main barrel portion in the tube. Accordingly, when such tubes, arranged in several rows, are to be fed onto a tray or the like, the seal portions of the tubes interfere with the feeding and it is very difficult to feed the tubes simultaneously. For example, if the shape of a tube feed chute is made to fit the diameter of the barrel portion of the tube, passage of the seal portion through the chute is hindered, and if the shape of the tube chute is made to fit the width of the plate-like seal portion, a clearance is formed between the barrel portions of adjacent tubes and therefore, the barrel portions of the tubes can move out of alignment during the step of moving the tubes out of the chute, with the result being that it is difficult to fit the mouth portions of the tubes properly into the tray.

It is a primary object of the present invention to provide an apparatus in which a continuous operation of arranging tubes in rows on a tray and fitting the tubes in the tray can be accomplished at high efficiency by shifting the tray intermittently and feeding the tubes row by row through chutes into the tray.

More specifically, in accordance with the present invention, there is provided a tube caser comprising a slide plate for intermittently shifting a tray adapted for containing tubes therein, a chute for dropping tubes row by row, a frame for moving the dropped tubes onto the top face of the tray and a stuffing plate for stuffing the tubes into the tray.

A preferred embodiment of the present invention will now be described in detail by reference to the accompanying drawings.

BRIEF DESCRIPTION OF THE DRAWING

Referring to FIG. 1, a chute 2 is attached to a chute attachment stand 10 fixed to a machine stand 25. The chute 2 is partitioned into four chambers so that four tubes 1 can be dropped into the chute 2 from above with the mouth portions thereof being lowermost. The lower portion of the chute 2 is arranged so that it can be vertically aligned with a guide 19 which is fixed to a reciprocable feed frame 14. Two vertically spaced cylinders 3 and 4 are disposed rearwardly of the chute 2 so that downward movement of the rows of tubes in the chute 2 can be prevented by pressing the chute 2 from behind.

A plurality of pressing devices 35 is provided at the end of the cylinder 3 to press the side of tubes and to stop them, and a plurality of supporting devices 36 is provided at the end of the cylinder 4 to support tubes and prevent their downward movement.

Figure 1:
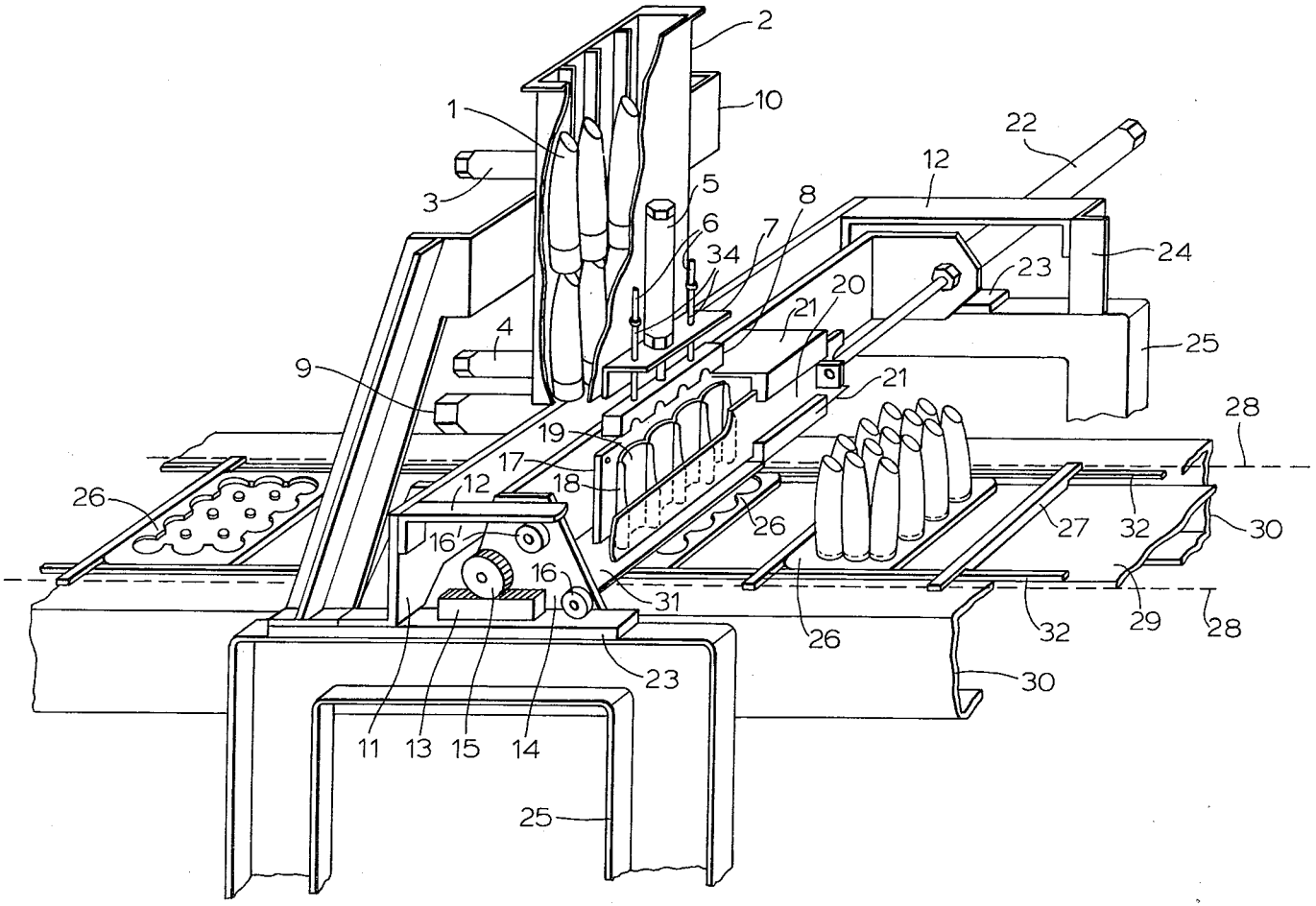
FIG. 1 is a perspective view of a preferred embodiment of the apparatus according to the present invention.
Figure 2:
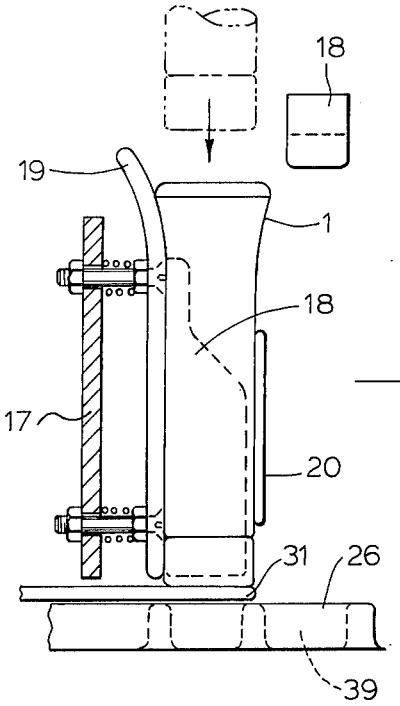
FIGS. 2, 3 and 4 are fragmentary side views showing the sequence of operations for stuffing tubes into the tray.

The feed frame 14 has pinions 15 on the side faces thereof, and said pinions 15 are engaged with racks 13 which are fixed to the machine stand 25 through attachment plates 23 whereby the frame 14 can be reciprocated a predetermined distance with respect to the machine stand. An attachment plate 17 is fixed to the frame 14, and as shown in FIG. 2, spring-urged guide plates 18 and 19 are supported on the attachment plate. By this arrangement, when the frame 14 is stopped in its rearwardmost position (leftwardmost position in FIG. 1), tubes falling from the lower end of the chute enter into the chambers defined by the guide plates 18 and 19. A frame-shifting cylinder 9 is disposed behind the frame 14. A tube-holding plate 20 is disposed in front of the guide plates 18. A stationary, tube-receiving, bottom plate 31 is disposed below the lower edges of the guide plates 18 and 19 and the holding plate 20. The tube-receiving plate 31 is fixed to a conveyor frame 30. The holding plate 20 is disposed so that it can be moved in a direction perpendicular to the direction of movement of the frame 14 by means of a guide 21 fixed to the frame 14 and such movement of the holding plate 20 is effected by a cylinder 22.

The conveyor frame 30 is located below the frame 14 and it extends in the same direction as the direction of movement of the frame 14. Guide bars 32 are fixed to the conveyor frame 30 and said guide bars are located on opposite sides of the zone through which the hereinafter-described trays move. Tray-pressing plates or bars 27 are attached to the top face of a slide plate 29 at predetermined intervals therealong. The opposite ends of the pressing plates 27 slidably contact the top faces of the guide bars 32, so that by moving the slide plate 29, both ends of the pressing plate 27 slide along the guide bars 32. The pressing plate 27 is located at a height almost equal to the height of a tray 26 so that when the tray 26 is placed on the slide plate 29, the pressing plate 27 can be advanced while pressing the rear edge of the tray. The guide bars 32 are spaced apart a distance approximately equal to the width of the tray, and the tray is always located on the center of the slide plate 29.

Figure 6:
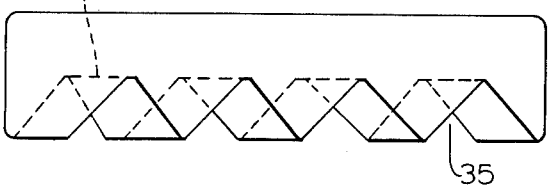
FIG. 6 is a front view of the stuffing plate.
Figure 8:
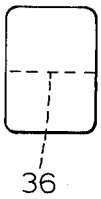
FIG. 8 is a side view of the stuffing plate.
Figure 7:
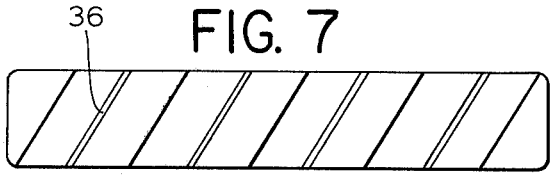
FIG. 7 is a view showing the lower face of the stuffing plate.

An attachment stand 7 is fixed to the front face of the chute 2. A tube-stuffing plate 8 is mounted on the lower end of a cylinder 5, which cylinder is fixed to the attachment stand 7, so that the tube-stuffing plate 8 is capable of vertical movement. Guide rods 34, are fixed to the stuffing plate 8 and slidably extend through holes in the attachment stand 7. Stoppers 6 are attached to the guide rods 34 for stopping the tube-stuffing plate 8 in its lowermost position. As shown in FIGS. 6 and 7 inverted V-shaped grooves 35 are formed on the lower face of the stuffing plate 8, and in each groove, the crest line 36 extends at an angle of about 45° to the lengthwise direction of the tube-stuffing plate 8.

A cam follower 16 is mounted on the frame 14 so that when the frame 14 is retracted (moved leftwardly in FIG. 1), the cam follower 16 contacts the front end of the rack 13 to stop the frame 14 at a predetermined rearward position, namely, at such a position that the lower portion of the chute 2 is in vertical alignment with and communicates with the chambers defined by the guide plates 18 and 19 and the holding plate 20. Another cam follower 16' is disposed in contact with a guide plate 12 fixed to an attachment stand 11 in order to prevent rising of the frame 14.

Figure 9:
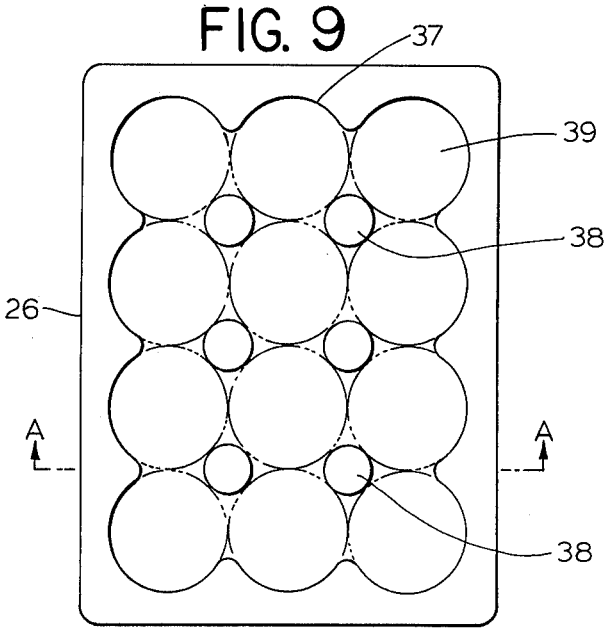
FIG. 9 is a plan view of the tray.
Figure 10:
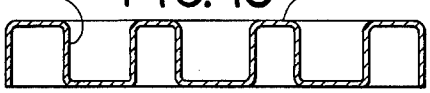
FIG. 10 is a sectional view taken along the line A—A in FIG. 9.
Figure 11:
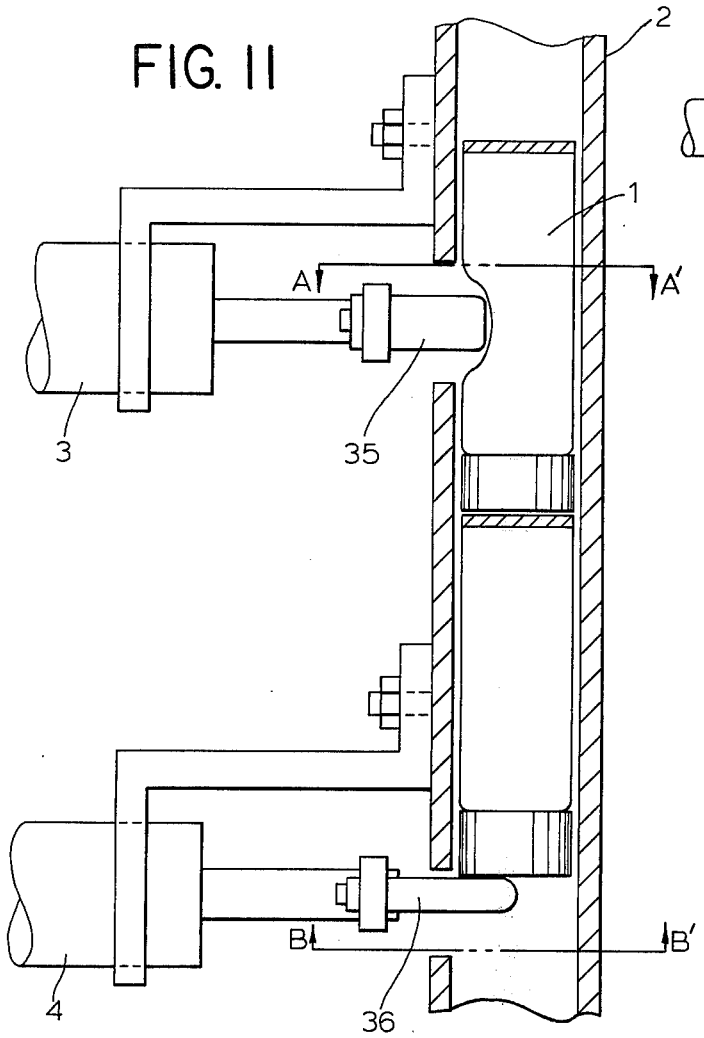
FIG. 11 is a side view of the ends of the cylinders 3 and 4.
Figure 12:
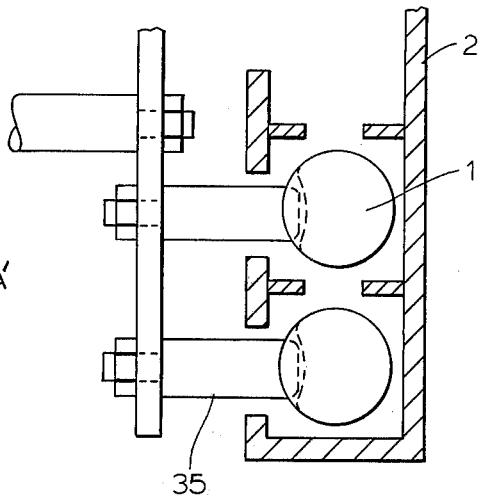
FIG. 12 is a sectional view taken along the line A — A′ in FIG. 11.
Figure 13:
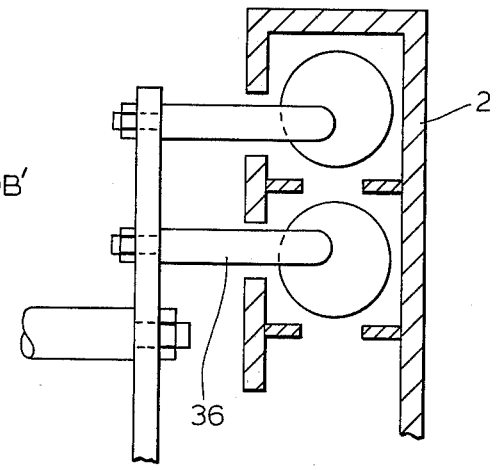
FIG. 13 is a sectional view taken along the line B — B′ in FIG. 11.

The configuration of the tray 26 is not particularly critical provided that concave portions 39 are formed thereon and into which the mouth portions of tubes are fitted. For example, there can be used a tray in which a prescribed number of upstanding cylindrical walls 38 are formed at centers of concave portions of a wavy or sinuous wall 37 to form tube mouth-fitting portions as shown in FIGS. 9 and 10.

The operation of the tube caser of the present device having the above structure will now be described.

A group of four tubes having their mouth portions disposed downwardly and their seal portions arranged in parallel to one another are fed from above the chute 2. The seal portions are disposed at an angle of about 45° with respect to the alignment direction of the tubes, that is, at an angle of about 45° to an imaginary plane passing through the centers of the tubes of a given row. The tubes are stopped at a position where they are pressed by the cylinder 3. In this case, each tube falls so that its plate-like seal portion extends diagonally to its chamber defined in the chute 2. When the pressing action of the cylinder 3 is released, the tubes fall down again and stop at the position whereat they are pressed by the cylinder 4. When another group of 4 tubes is similarly fed from above the chute 2, two upper and lower rows of the tubes are arranged in the chute 2.

The frame 14 is maintained stationary at the rearward position where the cam follower 16 contacts the rack 13. When the pressing action of the cylinder 4 is released, the tubes of the lower row fall down into the chambers defined by the guide plates 18 and 19 and the holding plate 20 and they are stopped in the state wherein the mouth portions of the tubes contact the receiving plate 31 (FIG. 2). Every time one group of 4 tubes are thus allowed to fall down, another group of 4 tubes is supplied from above the chute 2.

Figure 3:
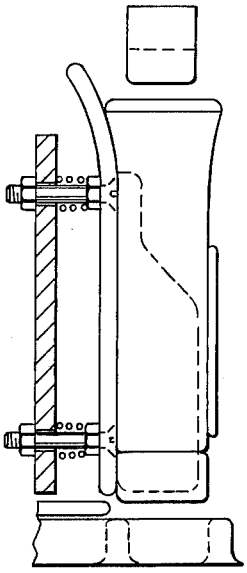
Figure 4:
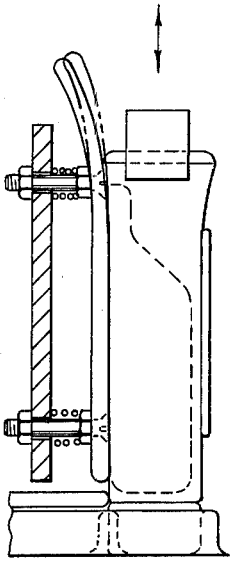
Figure 5:
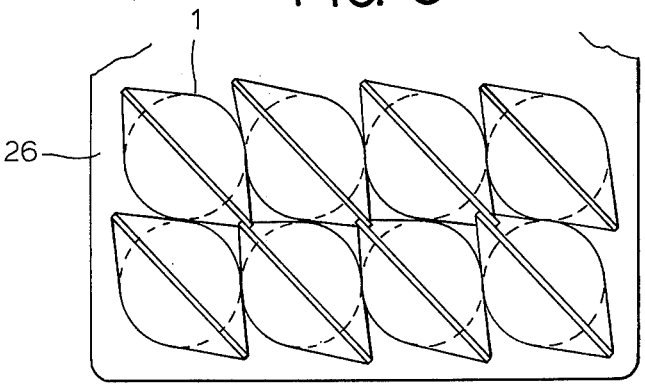
FIG. 5 is a plan view of the tubes fitted into the tray.

The slide plate 29 is stopped at such a position that the concave portions of the frontmost row of the tray 26 are disposed in front of the front end of the receiving plate 31 (FIG. 2). When the frame 14 is advanced by the cylinder 9, the condition of the parts as shown in FIG. 2 is changed to the condition shown in FIG. 3, wherein the mouth portions of the tubes are located above the concave portions 39 and the stuffing plate 8 is located above the seal portions of the tubes. When the stuffing plate 8 is moved down by the cylinder 5, the seal portions of the tubes are received in the inverted V-shaped grooves 35 of the stuffing plate 8. When the stuffing plate 8 is further moved downwardly, the mouth portions of the tubes are pressed downwardly and are fitted into the concave portions 39 of the tray 26. Then, the stuffing plate 8 is lifted and returned to its original position, and the holding plate 20 is separated from the front faces of the tubes by the cylinder 22. Further, the frame 14 is retracted to the original position, and the slide plate 29 is advanced a distance corresponding to the distance between the centers of the concave portions 39 of adjacent rows and then stops.

By the foregoing operation, tubes are fitted into the concave portions 39 of the frontmost row of the tray 26. By the same procedure, tubes are fitted into the concave portions 39 of the second and third rows of the tray 26, and thus, a prescribed number of tubes are fitted and fixed to the tray 26.

As will be apparent from the foregoing description, according to the present device, the tubes are fed to positions above the tray 26 in the state in which the seal portions of the tubes falling in the chute 2 extend diagonally in the chambers defined in the chute, and the tubes are stuffed into the tray by the stuffing plate having inverted V-shaped grooves which are formed in parallel to one another so that each of the crest lines of the grooves extends at an angle of about 45° to the longitudinal direction of the row of tubes at the stuffing step, whereby the tubes can be arranged and fitted into the tray effectively. If the tubes are pressed into the tray by using a stuffing plate free of such V-shaped grooves, the seal portions of adjacent tubes would contact one another and such troubles as falling-down of the tubes would readily occur and good results could not be obtained.

The embodiments of the invention in which an exclusive property or privilege is claimed are defined as follows:

1. An apparatus for inserting rows of tubes into a receptacle, which comprises:

intermittently movable conveyor means for supporting a receptacle, said conveyor means comprising an elongated planar member having upstanding longitudinally spaced-apart drive elements extending thereacross for engaging the rearward edges of receptacles in order to advance same in the lengthwise direction;

a chute disposed above said conveyor means and adapted for holding a row of tubes;

a movable feed frame disposed between said chute and said conveyor means, said feed frame having a plurality of chambers therein for receiving said row of tubes from said chute, said chambers being substantially U-shaped in cross section, said feed frame being movable between a first retracted position wherein said chambers are aligned to receive a row of tubes discharged from said chute and a second advanced position wherein said chambers are disposed above said receptacle;

a stationary tube-receiving bottom plate positioned above and extending crosswise of said conveyor means, said feed frame being disposed directly above said bottom plate so that in said first retracted position of said feed frame said bottom plate blocks the lower end of said chambers, said bottom plate terminating short of the position of said chambers in said second advanced position of said feed frame;

a reciprocable holding plate adapted to extend across the open sides of said chambers to retain tubes therein; and a movable presser member arranged to overlie said chambers when said feed frame is in said second advanced position to press said tubes downwardly into said receptacle, said presser member having inverted V-shaped grooves in the lower surface thereof for engaging the seal portions of said tubes, the crests of said V-shaped grooves extending at an angle of about 45° to an imaginary plane passing through the centers of a row of tubes when said row of tubes are positioned in said chambers in said second advanced position of said feed frame.

* * * * *